United States Patent [19]

Andreini et al.

[11] Patent Number: 4,772,451

[45] Date of Patent: Sep. 20, 1988

[54] LOW ALLOY STEEL FOR CASTER SHELL APPLICATIONS

[75] Inventors: Rockne J. Andreini, Redmond; Sveltana Yaguchi, Renton, both of Wash.

[73] Assignee: Earle M. Jorgensen Co., Seattle, Wash.

[21] Appl. No.: 103,180

[22] Filed: Sep. 30, 1987

[51] Int. Cl.[4] ..... C22C 38/44; C22C 38/46

[52] U.S. Cl. ..... 420/106; 420/109; 420/111; 420/113; 148/335

[58] Field of Search ..... 148/335; 420/106, 108, 420/109, 111, 113; 164/448

[56] References Cited

U.S. PATENT DOCUMENTS 4,210,468 7/1980 McGee ..... 148/335
4,409,027 10/1983 Cordea ..... 420/106

FOREIGN PATENT DOCUMENTS 54-18417 2/1979 Japan ..... 148/335

OTHER PUBLICATIONS

Nes, E. and Fartum, P., "Thermal Fatigue of Caster Shell Steels", Scandinavian Journal of Metallurgy, 1983, vol. 12, pp. 107–111.

Sandstrom, R., Samuelsson, A. Larsson, L., and Lundberg, L., "Crack Initiation and Growth During Thermal Fatigue of Aluminum Caster Shells", Scandinavian Journal of Metallurgy, 1983, vol. 12, pp. 99–105.

Chavanne-Ketin, "Shells and Roll Cores for Aluminum Continuous Casters", pp. 1–19.

*Primary Examiner*—Deborah Yee
*Attorney, Agent, or Firm*—Seed and Berry

[57] ABSTRACT

A low-alloy steel suitable for use in caster shells for continuous aluminum casting operations. It has a lower carbon and chromium content than prior art steels, and exhibits high yield strength at elevated temperatures, excellent toughness over the entire temperature range of aluminum casting, and decreased heat checking.

6 Claims, No Drawings

LOW ALLOY STEEL FOR CASTER SHELL APPLICATIONS

TECHNICAL FIELD

The present invention relates to a low-alloy steel for use in caster shells in continuous aluminum casting processes. The steel of the present invention resists cracking and exhibits high strength and high toughness at temperatures from 40° to 650° C.

BACKGROUND ART

During continuous casting of aluminum, the solidification and formation of the strip occur in contact with forged caster shells having an outer diameter of about 0.5–1.0 meters (21–40 inches). The casting speed is nominally about 1 RPM. During operation the caster shells are water cooled. The maximum temperature is approximately 575° C. to about 650° C., while the minimum temperature is as low as about 40° C. Thus, the surface of the shell is exposed to a temperature variation of about 600° C. with a cycle time of about 1 minute. The rapid thermal cycling has the consequence that extensive thermal fatigue cracking or "heat checking", takes place. The resulting crack pattern of the caster shell is imparted to the aluminum strip, thus producing unacceptable aluminum product. In operation, the caster shell must be disassembled and the crack pattern removed by machining. Extensive or repeated heat checking reduces the service life of the caster shell and increases the down time and the operating cost of the casting apparatus.

U.S. Pat. No. 4,409,027 issued to Cordea, et al. on Oct. 11, 1983 discloses a steel for use in caster shells for continuous aluminum casting. The steel described therein has a carbon content of about 0.53% to 0.58% and a chromium content of about 1.5% to 3.0%. While this steel is commonly currently used for caster shells, it is still prone to heat checking.

Literature references to thermal fatigue, thermal cracking, high temperature alloys and alloying elements include:

Nes, E. and Fartum, P., "Thermal Fatigue of Caster Shell Steels", Scandinavian Journal of Metallurgy, 1983, Vol. 12, pp. 107–111.

Sandstrom, R., Samuelsson, A., Larsson, L., and Lundberg, L., "Crack Initiation and Growth during Thermal Fatigue of Aluminum Caster Shells", Scandinavian Journal of Metallurgy, 1983, Vol. 12, pp. 99–105.

Chavanne-Ketin, "Shells and Roll Cores for Aluminium Continuous Casters", pp. 1–19.

DISCLOSURE OF THE INVENTION

The steel of the present invention is suitable for use in caster shells for continuous aluminum casting. It is a low alloy steel consisting essentially of, in weight percent, from about 0.30% to about 0.35% carbon, about 0.30% to about 0.60% manganese, about 0.015% maximum phosphorus, about 0.010% maximum sulfur, about 0.25% to about 0.40% silicon, about 0.30% to about 0.60% nickel, about 1.25% to about 1.5% chromium, about 0.90% to about 1.2% molybdenum, about 0.25% to about 0.35% vanadium, about 0.40% to about 0.60% tungsten, about 0.001% to about 0.003% boron, about 0.010% to about 0.015% nitrogen, with the balance being essentially iron. The steel exhibits a 0.2% yield strength of at least 60 ksi (415 MPa) and an elongation in 5.08 cm of at least 25% at 650° C. after forging and heat treating. The steel also exhibits a charpy impact value of at least 20 ft-lb (27.5 joules) at 40° C. and 50 ft-lb (68.5 joules) at 650° C. Finally, the steel has significant resistance to heat cracking in the temperature range of about 40° to about 650° C.

The preferred steel of the present invention consists essentially of, in weight percent, about 0.32% carbon, about 0.50% manganese, about 0.015% maximum phosphorus, about 0.010% maximum sulfur, about 0.30% silicon, about 0.50% nickel, about 1.35% chromium, about 1.00% molybdenum, about 0.30% vanadium, about 0.50% tungsten, about 0.002% boron, about 0.012% nitrogen, with the balance being essentially iron.

The steel of the present invention may be fashioned into a cylindrically-shaped caster shell and used in continuous aluminum casting. It exhibits the yield strength, elongation, and charpy impact values described above. Further, it has significant resistance to heat cracking during thermal cycling in the temperature range of about 40° to about 650° C.

BEST MODE FOR CARRYING OUT THE INVENTION

It is generally accepted among those skilled in the art that an optimal steel for use in caster shells would have the following properties: (1) a low coefficient of thermal expansion, (2) a high thermal conductivity, (3) a high yield strength at elevated temperatures, (4) a high degree of ductility at elevated temperatures, and (5) a low modulus of elasticity at elevated temperatures. In practice however, it is has been difficult to produce a steel with all of these properties. Prior art attempts have focused primarily on obtaining a high yield strength at elevated temperatures. While important, high yield strength must be balanced by high temperature ductility and excellent toughness over the complete operating temperature range of an aluminum casting process in order to minimize heat checking. Moreover, the steel should be economical to produce and should be obtainable using common forging and heat treatment processes.

The present invention discloses a low-alloy steel having a high yield strength at elevated temperatures, as well as ductility and excellent toughness throughout the entire operating temperature range of the casting process. Moreover, the steel of the present invention contains only a minimum of expensive alloying elements and can be fabricated using conventional forging and heat treating techniques well known in the art, including melting, secondary refining, forging, quenching and tempering.

The composition of the present steel is shown in Table 1 below, along with the compositions of the two steels most commonly used for caster shells. Alloy 1 is the steel disclosed in U.S. Pat. No. 4,409,027 issued to Cordea and obtainable from Armco Inc. Alloy 2 is a steel obtainable from Chavanne-Ketin. Alloy 3 is the steel of the present invention. As can be seen from the table, both the carbon content and chromium content of the present steel are substantially lower than those of the prior art steels. In addition, the present steel includes a few elements not present in the prior art steels, including tungsten, boron and nitrogen.

TABLE 1

| Composition of Alloy Steels by Weight Percent | | | |
|---|---|---|---|
| Element | Alloy 1 (Cordea) | Alloy 2 (C-K) | Alloy 3 (Present Invention) |
| Carbon | .53-.58 | .30-.35 | .30-.35 |
| Manganese | .40-1.00 | .40-.60 | .30-.60 |
| Silicon | .10-.20 | .25-.40 | .25-.40 |
| Phosphorus | .02 max | .015 max | .015 max |
| Sulfur | .02 max | .010 max | .010 max |
| Nickel | .45-.55 | .20-.40 | .30-.60 |
| Chromium | 1.5-3.0 | 2.9-3.2 | 1.25-1.5 |
| Molybdenum | .80-1.2 | .90-1.1 | .90-1.2 |
| Vanadium | .30-.50 | .15-.25 | .25-.35 |
| Tungsten | N/A | N/A | .40-.60 |
| Boron | N/A | N/A | .001-.003 |
| Nitrogen | N/A | N/A | .010-.015 |

A comparison of the tensile properties of the steel of the present invention with that of Cordea is shown in Table 2, below. As can be seen from the table, the steel of the present invention exhibits higher yield strength at elevated temperatures, comparable tensile strength at elevated temperatures, while maintaining satisfactory elongation and reduction of area values over the temperature range tested.

TABLE 2

| Property | Temperature °C. (°F.) | Alloy 1 (Cordea) | Alloy 3 (Present Invention) |
|---|---|---|---|
| 0.2% Yield Strength MPa (ksi) | 20 (70) | 1309 (190) | 1102 (160) |
| | 650 (1200) | 482 (70) | 551 (80) |
| Tensile Strength MPa (ksi) | 20 (70) | 1447 (210) | 1205 (175) |
| | 650 (1200) | 620 (90) | 620 (90) |
| % Elongation in 5 cm (2 in.) | 20 (70) | 12 | 15 |
| | 650 (1200) | 35 | 25 |
| % Reduction of Area | 20 (70) | 16 | 45 |
| | 650 (1200) | 95 | 85 |

Finally, Table 3 is a comparison of the toughness (charpy impact value) of the Cordea steel and the steel of the present invention. As can be seen from the table, the toughness of the present steel is excellent throughout a broad temperature range and at elevated temperatures is markedly higher than the toughness of the Cordea steel. This is critical from a fracture mechanics viewpoint, since increased toughness retards crack propagation.

TABLE 3

| Toughness at varying Temperature °C. (°F.) | Alloy 1 (Cordea) | Alloy 3 (Present Invention) |
|---|---|---|
| | Joules (ft-lb) | |
| 0 (30) | 18 (13) | 18 (13) |
| 32 (90) | 22 (16) | 22 (16) |
| 65 (150) | 27 (20) | 30 (22) |
| 93 (200) | 30 (22) | 51 (37) |
| 150 (300) | 34 (24) | 64 (46) |
| 204 (400) | 37 (27) | 66 (48) |
| 315 (600) | 38 (28) | 71 (52) |
| 427 (800) | 40 (29) | 77 (56) |
| 540 (1000) | 41 (30) | 77 (56) |

The preferred composition of the present invention is as follows: about 0.32% carbon, about 0.50% manganese, about 0.015% maximum phosphorus, about 0.010% maximum sulfur, about 0.30% silicon, about 0.50% nickel, about 1.35% chromium, about 1.00% molybdenum, about 0.30% vanadium, about 0.50% tungsten, about 0.002% boron, about 0.012% nitrogen, with the balance being essentially iron.

From the foregoing, it will be appreciated that, although embodiments of the invention have been described herein for purposes of illustration, various modifications may be made without deviating from the spirit and scope of the invention. Accordingly, the invention is not limited except as by the appended claims.

We claim:

1. A low alloy steel consisting essentially of, in weight percent, from about 0.30% to about 0.35% carbon, about 0.30% to about 0.60% manganese, about 0.015% maximum phosphorus, about 0.010% maximum sulfur, about 0.25% to about 0.40% silicon, about 0.30% to about 0.60% nickel, about 1.25% to about 1.5% chromium, about 0.90% to about 1.2% molybdenum, about 0.25% to about 0.35% vanadium, about 0.40% to about 0.60% tungsten, about 0.001% to about 0.003% boron, about 0.010% to about 0.015% nitrogen, and balance iron.

2. The steel of claim 1 consisting essentially of, in weight percent, about 0.32% carbon, about 0.50% manganese, about 0.015% maximum phosphorus, about 0.010% maximum sulfur, about 0.30% silicon, about 0.50% nickel, about 1.35% chromium, about 1.00% molybdenum, about 0.30% vanadium, about 0.50% tungsten, about 0.002% boron, about 0.012% nitrogen, and balance iron.

3. The steel of claim 1 exhibiting: a 0.2% yield strength of at least 60 ksi (415 MPa); an elongation in 5.08 cm. (2 in.) of at least 25% at 650° C., after forging and heat treating; and a charpy impact value of at least 20 ft-lb. (27.5 joules) at 40° C. and 50 ft-lb (68.5 joules) at 650° C.; and having significant resistance to heat checking in the temperature range of about 40° C. to about 650° C.

4. A roll caster shell for use in the continuous casting of aluminum, comprising a forged, heat treated cylinder fabricated from a low alloy steel consisting essentially, in weight percent, from about 0.30% to about 0.35% carbon, about 0.30% to about 0.60% manganese, about 0.015% maximum phosphorus, about 0.010% maximum sulfur, about 0.25% to about 0.40 % silicon, about 0.30% to about 0.60% nickel, about 1.25% to about 1.5% chromium, about 0.90% to about 1.20% molybdenum, about 0.25% to about 0.35% vanadium, about 0.40% to about 0.60% tungsten, about 0.001% to about 0.003% boron, about 0.10% to about 0.015% nitrogen, and balance iron, wherein said steel has high strength and excellent toughness at elevated temperatures, and is suitable for use in roll caster shells used in the continuous casting of aluminum.

5. The roll caster shell of claim 4 wherein the low alloy steel consists essentially of, in weight percent, about 0.32% carbon, about 0.50% manganese, about 0.015% maximum phosphorus, about 0.010% maximum sulfur, about 0.30% silicon, about 0.50% nickel, about 1.35% chromium, about 1.00% molybdenum, about 0.30% vanadium, about 0.50% tungsten, about 0.002% boron, about 0.012% nitrogen, and balance iron.

6. The roll caster shell of claim 4 wherein the low alloy steel exhibits a 0.2% yield strength of at least 60 ksi (415 MPa); an elongation in 5.08 cm. (2 in.) of at least 25% at 650° C., after forging and heat treating; and a charpy impact value of at least 20 ft-lb. (27.5 joules) at 40° C. and 50 ft-lb (68.5 joules) at 650° C.; and having significant resistance to heat checking in the temperature range of about 40°]C. to about 650° C.

* * * * *